United States Patent [19]

Celant

[11] Patent Number: 4,924,803

[45] Date of Patent: May 15, 1990

[54] POWDER BOOTH FOR APPLYING COATING POWDER TO ARTICLES

[75] Inventor: Jean J. Celant, Serignan du Comtat, France

[73] Assignee: Lune, Vinzelles, France

[21] Appl. No.: 329,541

[22] Filed: Mar. 28, 1989

[51] Int. Cl.[5] ..... B05B 1/28

[52] U.S. Cl. ..... 118/630; 118/629; 118/300; 118/326

[58] Field of Search ..... 118/629, 630, 308, 326; 98/115.2

[56] References Cited

U.S. PATENT DOCUMENTS

| | | | |
|---|---|---|---|
| 3,741,155 | 6/1973 | Hunder | 98/115.2 |
| 3,902,455 | 9/1975 | Lehmann et al. | 98/115.2 |
| 3,921,576 | 11/1975 | Vertue | 118/326 |
| 4,715,314 | 12/1987 | Ramseier et al. | 118/326 |

FOREIGN PATENT DOCUMENTS

| | | | |
|---|---|---|---|
| 2704497 | 8/1978 | Fed. Rep. of Germany | 118/326 |

*Primary Examiner*—Bernard Nozick
*Attorney, Agent, or Firm*—Herbert Dubno

[57] ABSTRACT

An electrostatic powder coating booth has double walls which can be evacuated to hold replaceable cover foils thereagainst so that, for a color change, a contaminated stretch of foil can be replaced by a fresh stretch of foil.

20 Claims, 5 Drawing Sheets

POWDER BOOTH FOR APPLYING COATING POWDER TO ARTICLES

SPECIFICATION

1. Field of the Invention

My present invention relates to a powder booth and, more particularly, to a booth in which articles or objects can be coated with a powder and, especially, for the electrostatic powder coating of metallic objects with synthetic resin (thermoplastic) or other powder materials to form a coating on such objects.

2. Background of the Invention

For approximately the past 30 years, the application of organic resins in a powdered form to metal objects has come to replace the traditional liquid paints on an industrial scale for the coating of metal objects. The technique is particularly useful for the electrostatic powder coating of metal objects and has widespread commercial application.

Whether the powder spray or coating device is handled manually or is part of an automatic powder spray system, the powder coating is applied in a powder coating booth which confines the cloud of powder which is produced. A subatmospheric pressure, suction or low pressure zone generated within the booth allows recovery of the excess powder. The recovered powder can be filtered and then recycled to the powder-applying guns or nozzles.

When the color is to be changed it is necessary before the new powder of a different color is applied through the powder nozzles or guns, to clean the interior of the powder booth and to remove all traces of the powder of the first color if pollution of the new powder by the old is to be avoided. Such contamination of the new powder may result in color variations and defects in the coating process.

The cleaning process is slow and requires many manual operations so that the downtime of the apparatus is correspondingly long. The output of the apparatus, as a consequence, may be poor.

OBJECTS OF THE INVENTION

It is the principal object of the present invention to provide a powder booth which can be cleaned more readily than has been the case heretofore.

Another object of this invention is to provide a powder booth for the coating of objects with powder and which has a reduced downtime for the changeover from one color to the other.

Still another object of the invention is to provide a powder booth for the purposes described, especially for electrostatic powder spraying of metal objects, which will obviate the drawbacks of earlier powder booths especially with respect to changeover from one color of the sprayed powder to the next.

SUMMARY OF THE INVENTION

These objects are attained, in accordance with the invention, with a powder booth having external rigid walls and a floor through which air can be aspirated and whose walls and roof are doubled internally to provide an inner wall member spaced from the outer wall member and such that the inner wall member is permeable to air. The space between the two walls is subjected to suction, i.e. a subatmospheric pressure, adapted to draw against the inner wall members, a web, foil or film of a flexible material which is consumable and capable of sealing against passage of the particles which are used in the coating process.

According to the invention, with each color change, the suction in the interwall space is cut off and the web advanced to remove the contaminated portion from the spray compartment and replace that contaminated compartment with a fresh stretch of the web. The web preferably covers all of the exposed surfaces of the compartment with the exception of the floor and, more specifically, the zone of the floor through which air is aspirated to generate the subatmospheric pressure in the powder-spray compartment.

More specifically, the powder spray booth of the invention comprises:

a housing having a plurality of walls defining a powder-spray compartment, each of the walls having a rigid outer wall member and an inner wall member defining a space between them, the inner wall members being rigid and permeable to air;

means defining a floor for the compartment through which air can be aspirated, whereby particles of powder sprayed onto an object in the compartment can be drawn to the floor;

cover means including at least one replaceable flexible web overlying the inner wall members and covering same to prevent contamination of the inner wall members with sprayed powder, the cover means covering at least some of the surfaces bounding the compartment with the exception of the floor;

means for spraying an object with powder in the compartment while the surfaces are covered by the web; and means for evacuating the space to retain the web by suction against the inner wall members.

Advantageously, the width of the space between the inner and outer wall members is of the order of several centimeters. The cover means can include respective rollers on opposite sides of at least one of the inner wall members for respectively feeding the fresh stretch of web thereto and taking up the contaminated web therefrom.

According to a further feature of the invention, the inner wall members can have adjoining portions connected by rounded junctions to facilitate adhesion by suction of the web to the walls. At least one of the walls can have an opening communicating between the exterior and the powder-spray compartment, and a tubular member, preferably of square cross section, bounding this opening and formed with an end face composed of air-permeable material (e.g. a sintered powder). The tubular member can have suction applied thereto so that the porous end face can draw the web thereagainst and form a seal of the web around the powder spray nozzle or gun which can extend through the opening.

The web is advantageously composed of a flexible foil of a plastic material, e.g. a metallized plastic material, or of a metal such as aluminum.

It has been found to be advantageous to form the means for evacuating the interwall space with means for applying a greater suction to the space during application of the web to the inner wall members and a lesser suction during application of the powder to the objects.

The angularly adjoining parts of the inner wall member can form obtuse angles with one another, again to facilitate the emplacement of the web against the inner surface of the rigid inner wall members.

According to another feature of the invention, means is provided for automatically applying the web to the inner wall members, i.e. so that there is no need for an operator to reach into the powder-spray compartment.

Openings formed in the wall for passage of the powder spray nozzles or guns can be provided with means for selectively blocking these openings, e.g. in the form of sliding doors.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
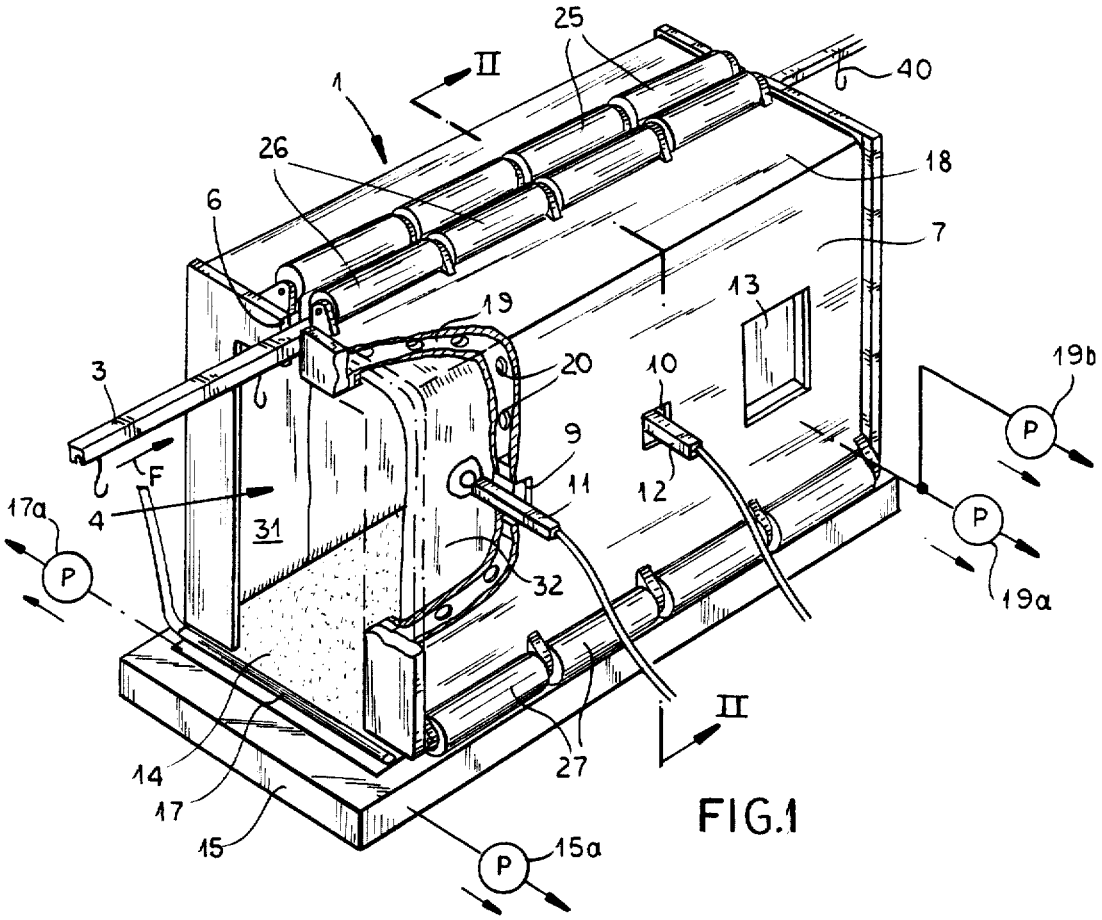
FIG. 1 is a perspective view partly broken away of a powder spray booth for the electrostatic coating of objects with powder.

The powder booth shown at 1 in FIGS. 1 through 4 is used for the electrostatic powder coating of an object (not shown) which can be passed continuously through the elongated coating compartment, suspended on metal hooks 40 which are circulated by on endless conveyor 3 of the apparatus.

The booth 1 has a generally parallelepipedal configuration and is provided with a number of openings including:

a front opening 4 and a rear opening 5, respectively having the profile of the compartment and, therefore, identifiable as "silhouettes" and providing incoming and outgoing passages for the objects to be coated;

an opening or slot 6 extending longitudinally along the roof 18 of the booth 1 and providing passage for the conveyor 3; and on each of the two longitudinally extending lateral walls 7 and 8 of the booth, two openings 9 and 10 through which automatic projection heads or nozzles 11 and 12 can extend to discharge the powder toward the object, and an opening 13 through which a manual powder projector, not shown in the drawing, can be introduced into the chamber.

In a conventional manner, the floor of the booth can be formed by a rotating filtering carpet 14 which is endless and therefore forms a belt and which is permeable to air. Through this filter, air can be aspirated to place the interior of the booth under a subatmospheric pressure or suction so that excess powder is collected on the belt 14.

This suction can be applied by a reduced pressure communicating to the interior of a hollow box or plenum 15 via a suction pump 15*a* shown in highly diagrammatic form.

The plenum 15 can also be provided with a pair of rollers 16 (see FIG. 2) over which the belt 14 passes.

The belt 14 is circulated so that its upper surface moves in a direction opposite the direction F in which the objects suspended by the hooks 40 are moved through the compartment 1*a* in which powder coating is to be effected.

An aspiration chute 17 is located at the downstream end of the belt 14 and can be subjected to suction by another suction pump 17*a* developing a greater suction than that of the pump 15*a*, so as to draw off the powder collected on the belt for filtering and recycling by means not shown but well known in the powder coating art.

Figure 1A:
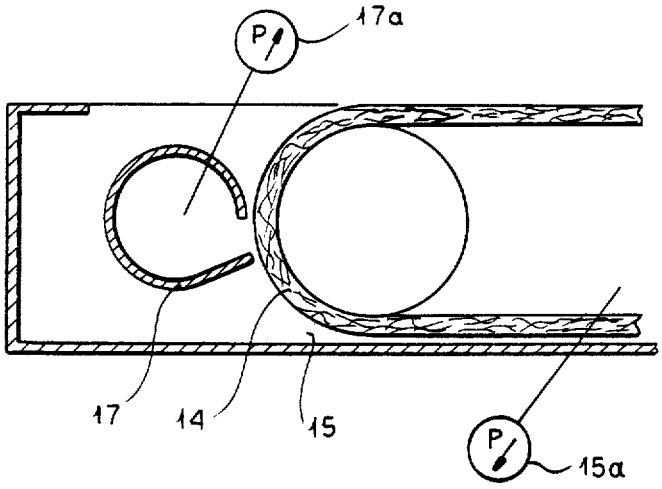
FIG. 1A is a diagrammatic section through the aspiration shoot and belt of FIG. 1 drawn to a larger scale.

FIG. 1A shows the relationship of the aspiration shoot 17 at the downstream end of the belt 14 and which is connected to the suction pump 17*a* and the belt 14 and its hollow box of plenum which is evacuated by the suction pump 15*a*.

According to the invention, the lateral walls 7 and 8 of the booth and its roof 18 are double walls, provided with an inner wall member 19 spaced by a distance of 3–5 centimeters from the external wall members of the wall 7, 8 and the roof 18. The inner wall members 19 are provided with a multiplicity of holes 20 rendering the inner wall members permeable to air.

The inner wall members are connected selectively to one of two suction pumps 19*a* and 19*b*, the former being designed to deliver a greater suction force than the latter.

The space 21 between the two wall members, therefore, can be placed at a pressure less than that within the compartment 1*a*.

Figure 4:
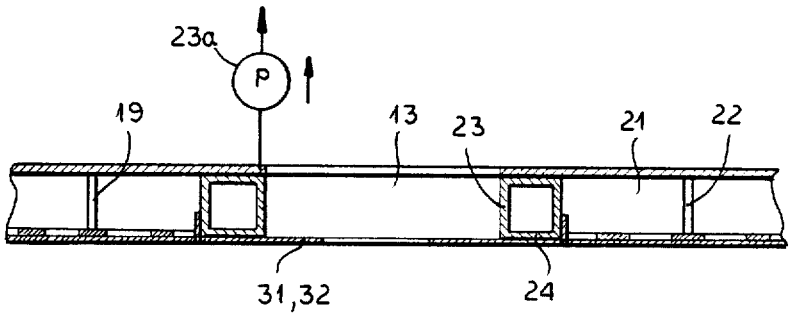
FIG. 4 is a transverse section, drawn to a larger scale, illustrating one of the openings through which a powder spray nozzle can be inserted into the compartment.

The rigid metal wall member 19 is supported by spacers 22 distributed over each of the inner wall members (FIG. 4).

The lateral openings 9, 10, 13 and the upper opening 6 of the booth can be bounded internally by tubes 23 which can be of square cross section and can have end faces 24 turned toward the compartment 1*a* constituted by a sintered porous material such as porous bronze. The tubes themselves are subjected to suction as represented by the suction pump 23*a* with a suction force greater than that provided in the space 21.

To opposite sides of the slot 6, the roof 18 of the booth carries two rows of rollers 25 and 26. In parallel to these rows of rollers, the large lateral walls 7 and 8 support at their lower portions respective horizontal rows of rollers 27 and 28 of the same diameters as the rollers 25 and 26. The rollers are all located outside the compartment 1*a*. All of the rollers 25 through 28 can be motorized by conventional means not shown in the drawing to rotate in the sense represented by the arrows in FIG. 2 for automatic replacement of the compartment-lining web.

Between the base of each of the walls 7 and 8 and the suction box 15, substantially over the entire lengths of these walls, longitudinal clearances 29 and 30 are provided.

The rollers 25 and 26 respectively serve to feed consumable and disposable foil webs 31 of, for example, a flexible plastic material, e.g. a polyethylene foil of a thickness of 0.05 to 0.15 mm. The foil supplied by the roller 25 has been shown at 31 while the foil supplied by the roller 26 has been shown at 32.

These foils are taken up respectively by the rollers 28 and 27 after passing through the slots 30 and 29.

The powder booth of FIGS. 1–4 is operated as follows:

At the end of a previous powder coating operation, the plastic foils 31 and 32 are found to cover substantially all of the internal surfaces of the booth with the exception of the filter belt 14.

Figure 2:
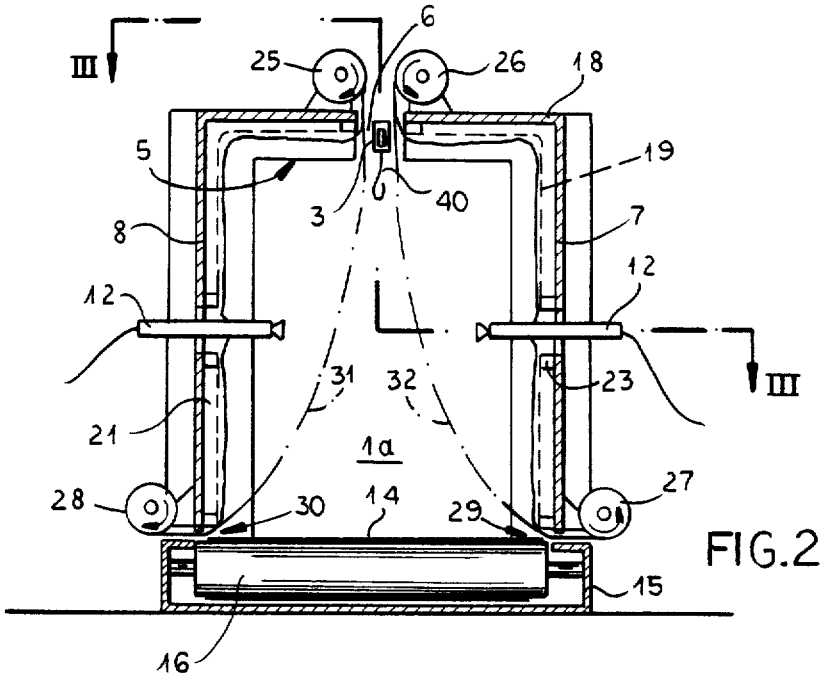
FIG. 2 is a section taken generally along the line II—II of FIG. 1.
Figure 3:
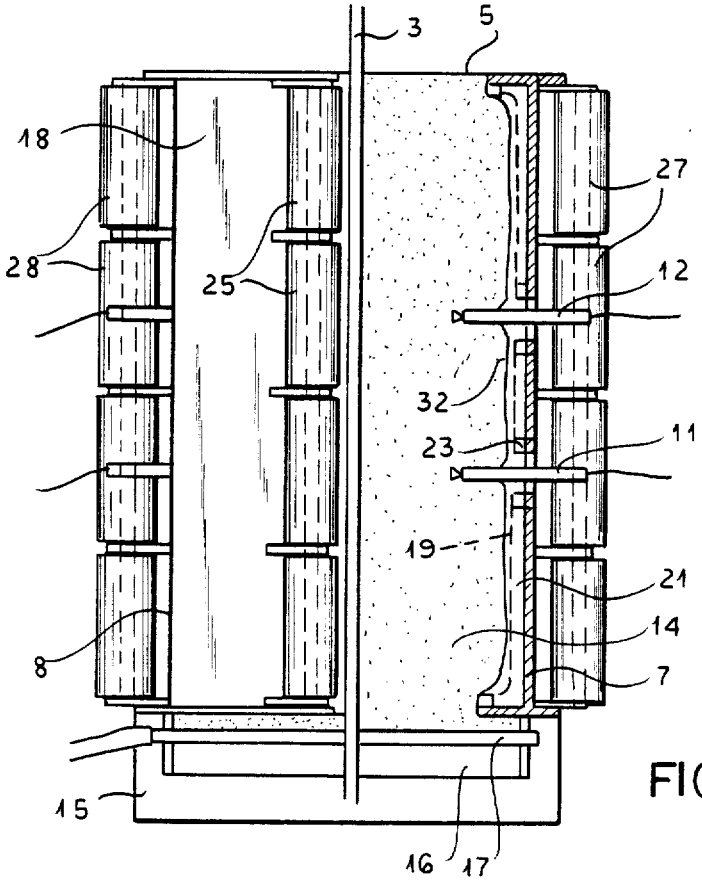
FIG. 3 is a view partly in section and as taken along the line III—III of FIG. 2.

Suction is cut off to the space 21 and the rollers 25 through 28 are driven to draw out the contaminated foil stretch previously covering the walls and to feed a fresh stretch of the foils 31, 32 as shown in dot-dash lines in FIG. 2. The rollers are then halted and using the suction turbine 19*a* a relatively high suction is generated in the space 21, for example of the order of 200–300 mm $H_2O$ column. The operator can then reach through one of the openings 4 and 5, and manually press the foils 31 and 32 against the perforated walls 19 after having cut out orifices corresponding to the openings passing the automatic powder spray guns 11 and 12. The adhesion of the plastic foils to the perforated walls 19 is ensured by the suction generated in the space 21. Even greater suction is applied through the wall of the tube 23 so that, at the porous face 24 of each of these tubes, the foil is held snugly around the openings.

The foil can also be cut away in the pattern of the opening 13 when a manual spray gun must be inserted.

The suction source 19*a* can then be cut off and another suction source 19*b* connected to apply a maintenance suction of the order of 120 mm $H_2O$ column to the space 21 so that the spray booth will operate at a lower noise level. Alternatively, means can be provided to reduce the speed of the turbine of the suction source 19 for this purpose.

Powder coating can then be effected in the manner described. For the next color change, the suction can be cut off to the tube 23 and the space 21 to allow the foils 31 and 32 to sag into their dot-dash position shown in FIG. 2. The rollers may again be driven to replace the contaminated foil with fresh foil as has been described.

The embodiment illustrated can be modified in a variety of ways. For example the booth need not be provided in conjunction with a conveyor but only with a front door for manual insertion and removal of objects. The perforated internal wall member may be made of plastic or other material of a rigidity sufficient to resist the suction applied between the two walls. The flexible foil can be composed of paper, aluminum or metallized plastic film.

The foils can be applied manually in separate sections if the automatic feed and take up rollers are not used. In the case of a small booth, a single foil may be provided which can cover the vertical wall and the walls provided with the silhouettes.

Figure 5:
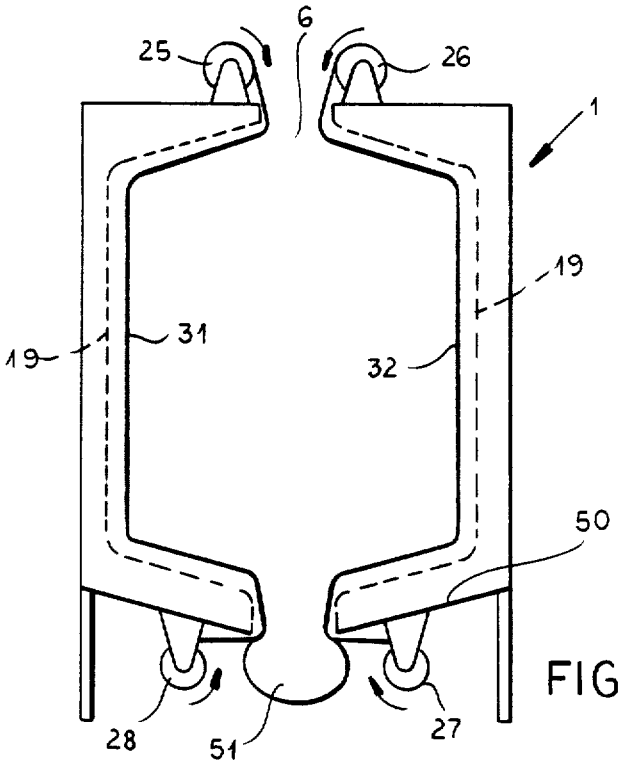
FIG. 5 is a diagram corresponding to FIG. 2 but in highly schematic form illustrating another embodiment of the configuration of the booth of FIG. 2.
Figure 6:
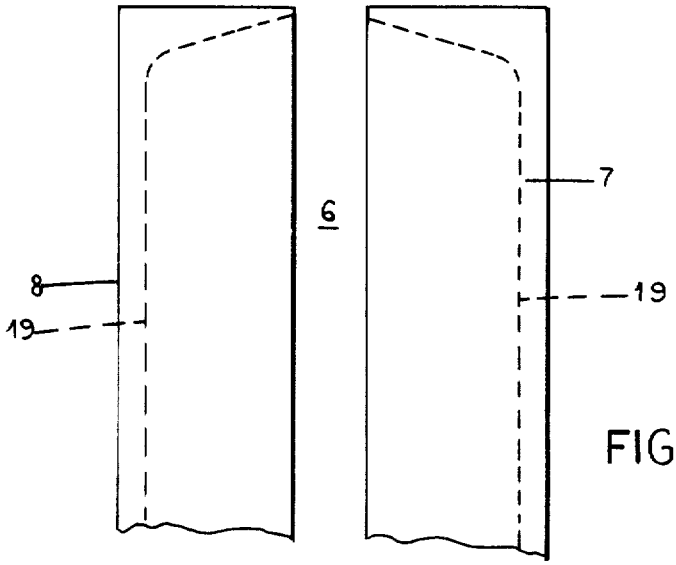
FIG. 6 is a partial top plan view of the booth of FIG. 3.

As illustrated, where wall portions adjoin one another at an interior angle, this angle should be greater than 90°, i.e. should can be obtuse angle (see FIGS. 5 and 6). The junctions between walls and wall portions should be rounded to facilitate application of the foil thereto.

FIGS. 5 and 6 illustrate diagrammatically these features and it will be apparent that the bottom of the booth here is somewhat pyramidal as illustrated at 50 while an evacuated trough 51 is used to receive the excess powder the angles and junctions are all rounded and greater than 90° between the different parts of the double wall 19. The protective film or foil of course will have dimensions greater than those of the walls to be covered, with the excess being easily cut to suit the walls.

Figure 7A:
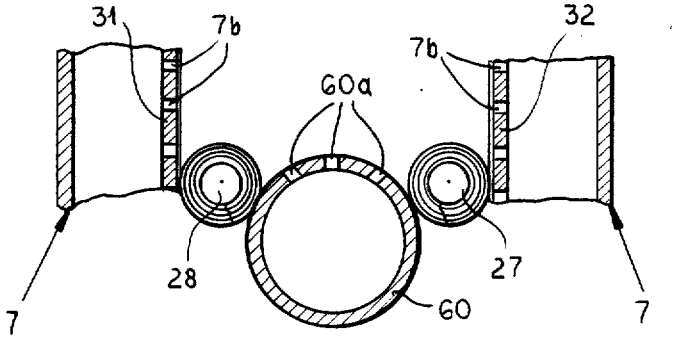
FIG. 7A is a cross sectional view through the bottom portion of the coating chamber of FIG. 7 showing the relationship between the walls, foils and floor thereof.
Figure 7:
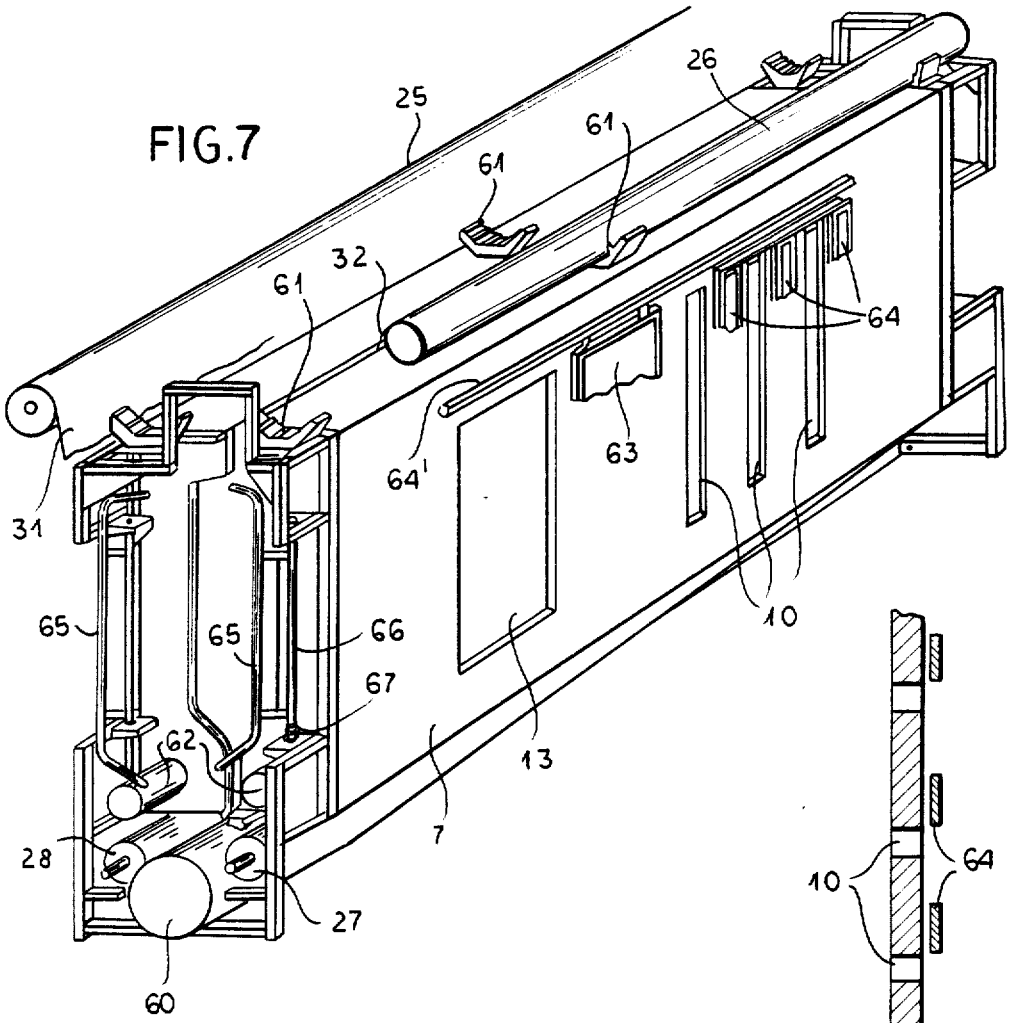
FIG. 7 is a partial perspective view illustrating another embodiment of the invention.
Figure 8:
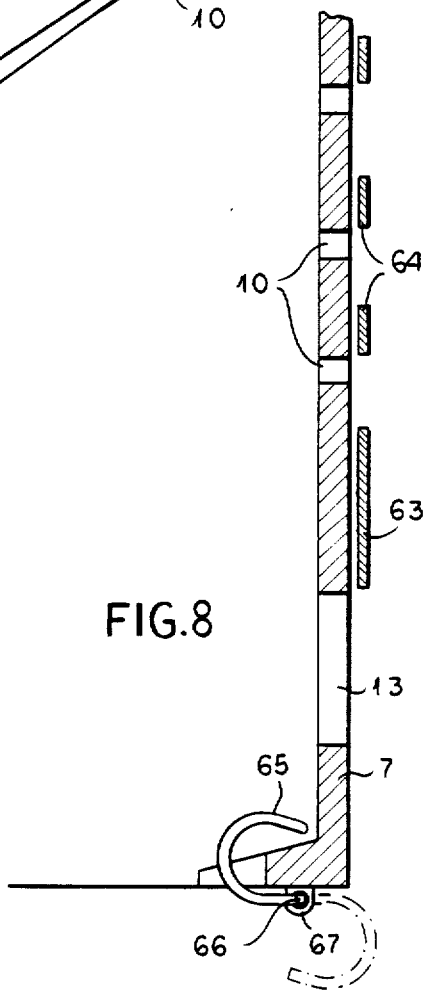
FIG. 8 is a fragmentary sectional view, greatly simplified, of a portion of the booth of FIG. 7.

The powder coating booth shown in FIGS. 7 and 8 has the advantage that it permits a semi-automatic application of the protective film to the inner wall members. Specifically this booth is equipped with mechanical means assisting the application of the film to the lateral walls.

This booth, like the booth shown in FIG. 5, is formed with a tubular structure 60 of somewhat frustoconical shape which is located in the floor of the booth. The remainder of the booth is essentially similar to that of FIG. 1 with minor differences. For example, the upper rollers 25 and 26 and the lower rollers 27 and 28 are each single rollers and rest upon the cradles 61 or are retained by appropriate trunnions. The booth has, at each lateral face, three openings 10 for passing the automatic powder projection heads and the single openings 13 for the passage of the manual projection head. In a diagrammatic fashion, the pipes 62 have been shown for evacuating the spaces 21 between the wall members.

From FIG. 7A it will be apparent that the foils 31 and 32 before reaching the rollers 27 and 28 on which they are wound up, lie along the walls 7 which are of double-wall structure and have perforations 7*b* by means of which upon evacuation of these walls as described, the foils are held against the walls. In this embodiment, the floor of the compartment through which air can be aspirated is formed by the tubular structure 60 which is evacuated and has perforations 60*a*.

What is significant here is that the booth has two complementary means designed to place the foils 31 and 32 against the inner wall members without the need for operator intervention in the interior of the booth. These means are the following:

on the outer parts of each of the lateral walls 7, 8, four slide supports 63, 64 are provided and are suspended from a common rail 64' so as to completely block, as required, the four openings 10 and 13 for passage of the powder spray guns in a manner such that the flow of air can practically be prevented; and at each of the longitudinal ends of the booth there are provided two vertical arms 65 which are articulated about respective vertical axes 66 and which are urged by springs 67 into positions pressing these arms toward the inner wall members of the walls 7 and 8 (see FIG. 8). Locking hooks not shown, permit, if required, spacing of the arms 67 from the inner wall members of the walls 7 and 8. The arms can extend over the major part of the height of the booth.

To effect a color change with this booth, without penetrating the interior of the booth, the four arms 65 can be swung manually to free the foils 31 and 32. The slides 63 and 64 are shifted to close the lateral openings. The rollers 25 through 28 are driven by respective motors to advance the foils 31 and 32 to withdraw the contaminated stretch and supply a sufficient length of a new stretch.

The four arms 65 are released so that they press the foils by the action of the springs 67 toward the inner wall surfaces, thereby creating an evacuation space which is practically closed between the foils 31 and 32 and the inner surfaces of the booth. Suction is then applied to the inner wall spaces 31 and automatically draws the foils uniformly against the inner wall surfaces in an improvement over the manual application of a foil thereto.

Indeed it is also advantageous to provide these arms 65 in the embodiment of FIGS. 1–4 as well.

I claim:

1. A powder-spray booth, comprising:

a housing having a plurality of walls defining a powder-spray compartment, each of said walls having a rigid outer wall member and an inner wall member defining a space between them, said inner wall members being rigid and permeable to air;

means defining a floor for said compartment through which air can be aspirated, whereby particles of powder sprayed onto an object in said compartment can be drawn to said floor;

cover means including at least one replaceable flexible web overlying said inner wall members and covering same to prevent contamination of said inner wall members with sprayed powder, said cover means covering at least some of the surfaces bounding said compartment with the exception of said floor;

means for spraying an object with powder in said compartment while said surfaces are covered by said web; and means for evacuating said space to retain said web by suction against said inner wall members.

2. The powder-spray booth defined in claim 1 wherein the width of said space between said inner and outer wall members is of the order of several centimeters.

3. The powder-spray booth defined in claim 1 wherein said cover means includes respective rollers on opposite sides of at least one of said inner wall members for feeding said web and taking up said web respectively.

4. The powder-spray booth defined in claim 1 wherein said walls have adjoining portions connected by rounded junctions to facilitate adhesion of said web to said walls.

5. The powder-spray booth defined in claim 1 wherein at least one of said walls has an opening communicating between the exterior and said compartment, a tubular member bounding said opening and formed with an air-permeable end face adapted to draw said web by suction thereagainst, said tubular member being formed from an air-permeable material, and means for applying suction to said tubular member.

6. The powder-spray booth defined in claim 1 wherein said web is composed of a flexible foil of a plastic material.

7. The powder-spray booth defined in claim 1 wherein said web is composed of a flexible foil of a metallized plastic material.

8. The powder-spray booth defined in claim 1 wherein said web is composed of a flexible foil of aluminum.

9. The powder-spray booth defined in claim 1 wherein said means for evacuating said space includes means for applying a greater suction to said space during application of said web to said inner wall members, and a lesser suction to said space during application of powder to said object.

10. The powder-spray booth defined in claim 1 wherein said walls have portions inclined at obtuse angles to one another with rounded junctions to facilitate application of said web to said inner wall members.

11. The powder-spray booth defined in claim 1, further comprising means for applying said web to said inner members without the need for an operator to reach into said compartment.

12. The powder-spray booth defined in claim 11, further comprising openings formed in said wall for passage of powder sprayers, and means for selectively blocking said openings.

13. The powder-spray booth defined in claim 12 wherein said means for selectively blocking said openings includes sliding doors.

14. The powder-spray booth defined in claim 12 wherein at each end of said housing arms are articulated for applying said web to said inner wall members.

15. The powder-spray booth defined in claim 1 wherein:

said housing is elongated and said walls include a pair of longitudinally extending vertical walls and a roof between said vertical walls, said roof being formed with at least one upper slot through which respective webs are guided to be fed onto said roof and said longitudinal walls;

roller means is provided at a top of said housing to feed said webs into said compartment along the inner wall members of said longitudinal walls; and further roller means is provided at a bottom of said housing for taking up contaminated webs from said inner wall members of said longitudinal walls.

16. The powder-spray booth defined in claim 15 wherein said walls have adjoining portions connected by rounded junctions to facilitate adhesion of said webs to the inner wall members of said walls.

17. The powder-spray booth defined in claim 16 wherein at least one of said walls has an opening communicating between the exterior and said compartment, a tubular member bounding said opening and formed with an air-permeable end face adapted to draw said web by suction thereagainst, said tubular member being formed from an air-permeable material, and means for applying suction to said tubular member.

18. The powder-spray booth defined in claim 17 wherein said webs are composed of a flexible foil of a material selected from the group which consists of plastic film, metallized plastic material and aluminum foil.

19. The powder-spray booth defined in claim 18 wherein said floor is formed by an endless belt of a filter material collecting powder thereon, further comprising means for aspirating powder from said belt.

20. The powder-spray booth defined in claim 19, further comprising a conveyor for objects to be sprayed extending through said housing parallel to said longitudinal walls.

* * * * *